US006506817B1

(12) United States Patent
Buchler

(10) Patent No.: US 6,506,817 B1
(45) Date of Patent: Jan. 14, 2003

(54) FLUID COMPOSITION FOR FORMING LUSTROUS CARBON DURING METAL CASTING AND PROCESS FOR ITS PREPARATION

(75) Inventor: Manfred Buchler, Senlis (FR)

(73) Assignee: Huttenes-Albertus France S.A.R.L. (FR)

( * ) Notice: Subject to any disclaimer, the term of this patent is extended or adjusted under 35 U.S.C. 154(b) by 0 days.

(21) Appl. No.: 09/586,371

(22) Filed: Jun. 2, 2000

Related U.S. Application Data

(63) Continuation of application No. PCT/FR98/02602, filed on Dec. 2, 1998.

(30) Foreign Application Priority Data

Dec. 3, 1997 (FR) ..... 97/15239

(51) Int. Cl.[7] ..... B22C 3/00
(52) U.S. Cl. ..... 523/139
(58) Field of Search ..... 523/139, 141, 523/143, 145

(56) References Cited

U.S. PATENT DOCUMENTS

| | | | | |
|---|---|---|---|---|
| 3,666,706 A | | 5/1972 | Hespers | |
| 4,174,225 A | * | 11/1979 | Lundgren et al. | 106/38.6 |
| 4,980,394 A | * | 12/1990 | Lemon et al. | 523/145 |
| 5,027,890 A | * | 7/1991 | Lemon et al. | 164/526 |

FOREIGN PATENT DOCUMENTS

| | | |
|---|---|---|
| DE | 2 158 947 | 6/1972 |
| DE | 38 41 473 A1 | 6/1990 |
| DE | 19643 514 A1 | 4/1998 |
| EP | 0 549 547 A1 | 6/1993 |
| JP | 58 020 344 | 2/1983 |
| WO | WO 99/28064 | 6/1999 |

* cited by examiner

*Primary Examiner*—Edward J. Cain
*Assistant Examiner*—Katarzyna W. Lee
(74) *Attorney, Agent, or Firm*—Schnader Harrison Segal & Lewis LLP

(57) ABSTRACT

A fluid composition additive for foundry casting sands enabling formation of lustrous carbon, including a liquid support and particles of at least one substance other than coal capable of forming lustrous carbon during metal casting.

18 Claims, No Drawings

FLUID COMPOSITION FOR FORMING LUSTROUS CARBON DURING METAL CASTING AND PROCESS FOR ITS PREPARATION

RELATED APPLICATION

This is a continuation of International Application No. PCT/FR98/02602, with an international filing date of Dec. 2, 1998, which is based on French Patent Application No. 97/15239, filed Dec. 3, 1997.

FIELD OF THE INVENTION

This invention relates to the foundry field, more specifically to a new lustrous carbon former.

BACKGROUND

Lustrous carbon formers are carbon-containing substances added to casting sand in foundries to facilitate release, at the moment of casting, hydrocarbon type volatile materials. The role of such carbon formers is to create a reducing atmosphere in the mold enclosure, and to form a carbon deposit of graphitic appearance on the surface of the castings, thereby improving their appearance.

Traditionally, finely ground coal dust is the most widely used substance, with a lustrous carbon formation capacity on the order of 8 to 10% of its weight. Other substances, such as tars, bitumens, certain resins, or polymers such as polystyrene, are used in mixture with the coal dust so as to increase the lustrous carbon formation capacity.

Most of the lustrous carbon formers are used in the form of a finely divided powder the grain size of which is smaller than 650 microns, with more than 50% smaller than 150 microns. However, these powders, which are organic in nature, are susceptible of spontaneous combustion, dust explosion and clumping in their containment silos.

Certain manufacturers, including the Applicant, have attempted to replace the powders with liquids such as bituminous oils to overcome these drawbacks. It has been found in practice that these oils could not be incorporated in the sand in a sufficient quantity to satisfy the lustrous carbon requirement because the sand becomes too plastic and there is an excessive emission of fumes upon casting. The use of these oils has, therefore, remained limited to a few special cases. Other manufacturers have tried to commercialize suspensions of coal dust in water, but this product has been found to be too expensive compared to conventional coal dust.

Certain manufacturers have somewhat circumvented the problem of storing pulverulent materials by mixing them with bentonite, which is another common component of foundry casting sand. These mixtures, which have acquired a notable share of the market in Europe, exhibit a lustrous carbon formers/bentonite ratio between 5 and 0.2. However, the favorable influence of such mixtures on the storage safety problems is only perceptible for high bentonite contents and the safety problems are not truly resolved. In addition, these mixtures are less flexible for foundry use because the lustrous carbon formers/bentonite ratio is predefined. This often forces the foundries to maintain a small separate stock of lustrous carbon formers.

The toxicity problems of the polycyclic aromatic hydrocarbons generated by the lustrous carbon formers such as coal justify the search for new replacement or enrichment products, the selection of which is still limited by the demanding criteria concerning the storage of pulverulent material.

SUMMARY OF THE INVENTION

The invention provides a solution to the problems outlined above. This is attained in one aspect of the invention by means of an additive for foundry casting sands enabling formation of lustrous carbon and consisting of a fluid composition comprising a liquid support and particles of at least one substance other than coal which is capable of forming lustrous carbon during metal casting.

In another aspect, the invention includes a process for the preparation of a composition for foundry molding comprising mixing foundry sand with at least about 0.05% by weight of the additive either directly or as an intermediary of a premix with other materials.

DETAILED DESCRIPTION OF THE INVENTION

It will be appreciated that the following description is intended to refer to specific embodiments of the invention selected for illustration in the following text and is not intended to define or limit the invention other than in the appended claims.

Advantageously, the content of liquid support in the fluid composition of the invention is less than about 60% by weight of the composition. The liquid support is preferably water but it can also be selected from among the organic liquids stemming from the distillation of petroleum or coal, liquid derivatives extracted from plants and the like. The following can be cited as preferred examples: aromatic solvents, fatty acids, naphthene or terpene derivatives as well as their mixtures, alone or in water. In the compositions of the invention in which the liquid support is a mixture of water and at least one organic liquid, the water represents advantageously at least about 30% of the weight of the liquid support and/or at least about 5% by weight of the fluid composition of the invention.

The term "fluid composition" is understood to mean liquids as well as suspensions or pastes, which are essentially homogenous at least during their use.

The content of particles of a substance other than coal which is capable of forming lustrous carbon in the fluid composition of the invention is between about 85 and 5% by weight of the composition. Preferably, at least about 50% by weight of the particles in the composition of the invention are of a size smaller than about 500 microns.

All substance particles known for their capability to form lustrous carbon during metal casting in the mold use in the prior art in pulverulent form can be used within the framework of the invention. Especially preferred are bitumens, gilsonite, coumarone-indene resins, albores, certain polyolefins or polymers derived from them, resinous compounds obtained by the treatment of bis-phenol A manufacturing residues and the like.

However, the particles can also be constituted of any other material which is potentially beneficial but has drawbacks for application in pulverulent form, especially because of unfavorable physical characteristics such as, for example, poor suitability for grinding, high moisture content, tendency to clumping or to granular segregation. These materials are often waste products from polymer production, which are, at present, most frequently incinerated. The following are preferred examples of such materials: residues from the manufacture in emulsion or in suspension of polyolefins or their copolymers, residues which are often constituted of slurries or wet fines, residues from the granulometric selection of ion-exchange resins and the like.

Thus, in a general manner, the invention pertains to the use within a liquid support of particles of resinous compositions and, more specifically, of particles of polymer or copolymer or their mixture, the macromolecular chains of which comprise carbon and hydrogen atoms to the extent of at least about 80% of their weight. Among these, the invention envisages preferentially those of which:

The lustrous carbon formation capacity is at least about 15% by weight of their weight, measured by the method defined by the German foundry industry in Bestimmung von Glanzkohlenstoff—V.D.G. p. 85, October 1980.

The volatile material content is at least about 50% measured according to the ISO method 562–1981 and at least about 80% of the volatile material is released between about 200° C. and about 500° C.

The particles of substances capable of forming lustrous carbon which are preferred according to the invention have a low content of polycyclic aromatic hydrocarbons (e.g., benzo[a]pyrene <about 50 ppm) and a sulfur content lower than about 3%.

The fluid composition according to the invention can also comprise an adequate amount of one or more antisettling agents, flow agents or surface-active agents to prevent decantation of the particles or separation of the liquid phases. The following are among the preferred agents: clays, bentonites, surface-active agents, polysaccharides and the like.

The fluid composition of the invention can also include one or more additives known for their favorable effects in foundry sand, for example, of improving its fluidity, cohesion or locking. These additives can be, for example, saponified oils, fatty acids or their saponified or unsaponified esters, glycols, graphite, additives acting on bentonite activation such as certain bases and the like.

The fluid composition according to the invention can also comprise one or more additives known for their antifreeze effects such as the ethylene glycols, or their antibacterial effect such as formaldehyde.

Although one of the goals of the invention is to substantially eliminate, for occupational health reasons, the use of coal as a lustrous carbon former, it can be useful for technical or cost-related reasons, or because of raw material availability, to incorporate in the fluid composition of the invention coal dust the particle size of which is advantageously smaller than about 600 microns. In this case, the content by weight of the coal dust in the composition is preferably less than about 50%.

According to an advantageous mode of implementation of the fluid composition of the invention, the composition comprises up to about 50%, and preferably about 30%, by weight of a porous mineral powder such as, for example:

coke, about 80% by weight of which is constituted by particles of a size smaller than about 500 microns, and preferably about 70% by weight of which is constituted by particles of a size smaller than about 200 microns, a porous granular material containing silica or aluminum silicate, the particle size of which is smaller than about 600 microns.

The invention also pertains to a process for the preparation of a fluid composition according to the invention, comprised of incorporating in the liquid support of the particles at least one substance other than coal which is capable of forming lustrous carbon, either in the form of wet or dry fine particles about 50% by weight of which are of a size smaller than about 500 microns or by wet phase grinding with said liquid support. The liquid support and the particles used in this process conform to those described above for the fluid composition of the invention.

The invention also pertains to the use of particles of a substance other than coal which is capable of forming lustrous carbon during metal casting in the mold, for the preparation of a fluid composition constituting an additive for foundry casting sands. Such particles are of the type defined above for the fluid composition of the invention.

Finally, the invention pertains to the use of an additive as defined above for the preparation of a composition for foundry casting, as well as a composition for sand-based foundry casting comprising such an additive and the process for its preparation. A process for the preparation of a composition for foundry casting consists of mixing with the foundry sand, stemming for example from the return after mold breaking, an amount of at least about 0.05% by weight of an additive in accordance with the invention, either directly or via the intermediary of a premix with other materials.

Other advantages and characteristics of the invention will emerge upon the reading of the example below regarding the preparation and the use of the fluid composition of the invention in foundry practice.

The example below pertains to application tests as lustrous carbon formers in foundry practice of granulometric selection fines arising as waste products from the manufacture of styrene divinylbenzene (S-DVB) copolymer for ion-exchange resins.

These fines were first used in pulverulent form in accordance with the method of the prior art, mixing them with coat dust at the rate of 30% S-DVB fines and 70% coal dust. It could be seen by emptying this mixture onto a tray and tapping lightly on the tray that the grains of S-DVB fines separated clearly from the grains of coal and, thus, the mixture very readily became heterogeneous, which would prevent its use in foundry practice.

The above mixture was, therefore, incorporated into a liquid. The resultant fluid composition was used in a foundry mold:

a) Preparation of a pregel by mixing:
- 97 g of water,
- 0.14 g of Rhodadol 23 manufactured by the firm Rhone-Poulenc,
- 2.29 g of Empilan NP6 manufactured by the firm ALBRIGHT-WILSON,
- 0.57 g of Empicol ESB 3M manufactured by the firm ALBRIGHT-WILSON.

b) Preparation of the fluid composition by mixing:
- 30 g of coal dust,
- 35 g of S-DVB fines,
- 35 g of pregel from step (a) above.

The resultant mixture has a fluid and homogeneous appearance which it retains for more than three weeks, until its use described below:

c) Preparation of a foundry mold of the composition by weight below:
- 100 parts of siliceous sand of AFS granulometry,
- 7 parts of activated calcium bentonite,
- 3 parts of the fluid composition from step (b) above,
- 2 parts of water.

The liquid metal is then poured into the mold. After cooling, a casting was observed with an attractive, defect-free well scoured skin.

Although this invention has been described in connection with specific forms thereof, it will be appreciated that a wide array of equivalents may be substituted for the specific aspects described herein without departing from the spirit and scope of the invention as described in the appended claims.

What is claimed is:

1. A foundry molding sand comprising:

sand and bentonite;

and a fluid additive comprising:

a liquid support wherein the liquid support is a mixture of water and at least one organic liquid, in which the water represents at least about 30% of the weight of the liquid support; and particles of at least one substance, other than coal, for forming lustrous carbon during metal casting.

2. The foundry molding sand according to claim 1, wherein the content of liquid support is less than about 60% by weight of said fluid additive.

3. The foundry molding sand according to claim 1, wherein the content of particles is between about 85 and about 5% by weight of said fluid additive.

4. The foundry molding sand according to claim 1, wherein at least about 50% by weight of the particles contained in said fluid additive are of a size smaller than about 500 microns.

5. The foundry molding sand according to claim 1, wherein the particles contained in said fluid additive-are made from a resinous compound selected from the group consisting of polymers, copolymers and their mixtures, and having macromolecular chains of which comprise carbon and hydrogen atoms to the extent of at least about 80% of their weight.

6. The foundry molding sand according to claim 5, wherein the particles contained in said fluid additive are made from polyolefins or their copolymers or derived copolymers.

7. The foundry molding sand according to claim 1, wherein the particles contained in said fluid additive have a capacity of forming lustrous carbon of at least about 15% by weight of their weight measured according to a method defined in Bestimmung von Glanzkohlenstoff—V.D.G. p. 85, October 1980.

8. The foundry molding sand according to claim 1, wherein the particles contained in said fluid additive have a content of volatile material of at least about 50% measured according to ISO method 562–1981 and that at least about 80% of the volatile material is released between about 200° C. and about 500° C.

9. The foundry molding sand according to claim 1, wherein the particles contained in said fluid additive have a low content of polycyclic aromatic hydrocarbons and a sulfur content lower than about 3%.

10. The foundry molding sand according to claim 1, in which said fluid additive comprises one or more antisettling agents, flow agents or surface-active agents to prevent decantation of the particles or separation of the particles from the liquid phase.

11. The foundry molding sand according to claim 10, wherein the agents are selected from the group consisting of clays, bentonites, surface-active agents and polysaccharides.

12. The foundry molding sand according to claim 1, in which said additive comprises one or more additive agents selected from the group consisting of antifreeze agents, antibacterial agents and combinations thereof.

13. The foundry molding sand according to claim 1, in which said fluid additive comprises about 1 to about 50% by weight of coal dust having a particle size smaller than about 600 microns.

14. The foundry molding sand according to claim 1, in which said fluid additive comprises up to about 50% by weight of a coke powder, about 80% by weight of which is constituted by particles of a size smaller than about 600 microns.

15. The foundry molding sand according to claim 1, in which said fluid additive comprises up to about 30% by weight of a porous granular material containing silica or aluminum silicate, the particle size of which is smaller than about 600 microns.

16. A process for the preparation of a foundry molding sand according to claim 1, comprising incorporating into the liquid support of said fluid additive the particles, either in wet or dry form, wherein 50% by weight of the particles are of a size smaller than about 500 microns or by wet phase grinding with said liquid support.

17. A process for the preparation of a foundry molding sand, comprising mixing foundry sand, comprising sand and bentonite, with at least about 0.05% by weight of a fluid additive wherein the fluid additive comprises a liquid support wherein the liquid support is a mixture of water and at least one organic liquid, in which the water represents at least about 30% of the weight of the liquid support, and particles of at least one substance, other than coal, for forming lustrous carbon during metal casting.

18. A foundry molding sand comprising:

sand and bentonite; and a fluid additive comprising:

a liquid support wherein the liquid support is a mixture of water and at least one organic liquid, in which the water represents at least about 30% of the weight of the liquid support and/or at least about 5% by weight of the fluid additive; and particles of at least one substance other than coal for forming lustrous carbon during metal casting, wherein at least about 50% by weight of the particles are of a size smaller than about 500 microns and wherein the particles have a content of volatile material of at least about 50% measured according to ISO method 562–1981 and that at least about 80% of the volatile material is released between about 200° C. and about 500° C.

* * * * *